US005415350A

United States Patent [19]

Yoon et al.

[11] Patent Number: 5,415,350

[45] Date of Patent: May 16, 1995

[54] WATER SPRAYING DEVICE FOR TABLEWARE WASHER

[75] Inventors: Hong Y. Yoon; Heui W. Kim; Seong G. Kang, all of Seoul, Rep. of Korea

[73] Assignee: Goldstar Co., Ltd., Seoul, Rep. of Korea

[21] Appl. No.: 204,983

[22] Filed: Mar. 2, 1994

[30] Foreign Application Priority Data

Mar. 6, 1993 [KR] Rep. of Korea ..... 3381/1993
Mar. 6, 1993 [KR] Rep. of Korea ..... 3382/1993
Apr. 27, 1993 [KR] Rep. of Korea ..... 7081/1993

[51] Int. Cl.[6] ..... B05B 3/06

[52] U.S. Cl. ..... 239/227; 239/255; 239/261; 239/263.3; 134/179

[58] Field of Search ..... 239/227, 251, 255, 261, 239/263.3; 134/179

[56] References Cited

U.S. PATENT DOCUMENTS 3,355,110 11/1967 Thompson ..... 239/255 X
3,596,834 8/1971 Cushing ..... 239/255
3,642,208 2/1972 Guth ..... 239/255
3,799,445 3/1974 Marino ..... 239/255 X
4,013,222 3/1977 Travaglio ..... 239/255 X
4,175,575 11/1979 Cushing ..... 239/255 X
4,884,585 12/1989 Oh ..... 239/255 X

*Primary Examiner*—Andres Kashnikow
*Assistant Examiner*—Lesley D. Morris
*Attorney, Agent, or Firm*—Fish & Richardson

[57] ABSTRACT

A water spraying device for a tableware washer. The water spraying device comprises a rotatable frame, a water spraying arm rotatably supported by the frame and turned along with the frame, a water guide member for guiding the water to the spraying arm. The fixed shaft is mounted on the water guide member such that it vertically penetrates the support frame and exposes its top end to bile outside of the support frame. The support member is fixedly mounted on the top end of the shaft. The guider having a guide slot is fixedly mounted on the spraying arm. The connecting rod is movably placed on the support frame and levered by a hinge pin of the support frame, thus to convert a turning motion of the support frame into an opposed directional rotating motion of the spraying arm and to change the direction of the water spraying holes of the arm. The spraying device makes the spraying arm repeat an opposed directional rotation simultaneously with turning when the upper frame is turned, thus to enlarge the water spraying range and be improve the washing efficiency of the tableware washer.

9 Claims, 11 Drawing Sheets

WATER SPRAYING DEVICE FOR TABLEWARE WASHER

BACKGROUND OF THE INVENTION

1. Field of the Invention

The present invention relates in general to a tableware washer for automatically washing tableware and, more particularly, to a water spraying device for the tableware washer having a rotatable water spraying arm.

2. Description of the Prior Art

Tableware washers are used for automatically washing tableware stained with food remnants. As well known to those skilled in the art, a tableware washer should be provided with means for spraying water upon tableware laid on a rack of the washer.

With reference to FIGS. 1 and 2, there is shown a conventional tableware washer in a partially broken view and a water spraying device of the washer in a partially sectional view respectively. The water spraying device comprises a spraying arm 6 and a spraying arm rotating mechanism. In order to not only support the spraying arm 6 and the arm rotating mechanism but also guide water to the arm 6, the device further includes a frame 1 comprising an upper frame 1*a* and a lower frame 1*b*. Here, the upper frame 1*a* is rotatable with respect to the lower frame 1*b* and rotatably receives the spraying arm 6 at its upper section such that the arm 6 diametrically extends outward. A ring gear 4 having teeth on its annular top surface is mounted on the top of the lower frame 1*b*.

At the outside of the upper frame 1*a*, a spur gear 5 gears into the ring gear 4. This spur gear 5 is rotatably mounted on the side wall of the upper frame 1*a* such that its rotating shaft 3 is vertically mounted on the side wall of the frame 1*a*. The rotatable spur gear 5 is connected to the spraying arm 6 by a connecting rod 7, to cause the spring arm 6 to rotate back and forth in opposite directions as the spur gear 5 rotates about the ring gear 4. This connecting rod 7 is hinged to both a portion of the spur gear 5, the portion being spaced apart from the rotating shaft 3 by a distance l, and an outer surface of the spraying arm 6.

In operation of the washer, a power switch of the washer is switched on under the condition that the tableware stained with food remnants is laid on a rack 9 inside a washer housing 8, a drive motor 10 starts and generates a pumping force for supplying the water under a given pressure to the spraying arm 6 through a water passage 2 in the upper frame 1*a*. At this time, opposed ends of the spraying arm 6 are provided with eccentric holes, so that there is generated a rotating force in both the arm 6 and the upper frame 1*a* when the pressurized water is ejected from the eccentric holes. Hence, the arm 6 and the upper frame 1*a* are turned in one direction about the lower frame 1*b*.

The spur gear 5 of the upper frame la gearing into the ring gear 4 is thus rotated about its shaft 3 and moves along the ring gear 4. As a result of rotation of the spur gear 5, the spraying arm 6 rotatably received in the upper frame 1*a* and hinged to the connecting rod 7 is alternately rotated in opposed directions at a rotating angle determined by the distance l between the eccentric hinged portion and the rotating shaft 3 of the spur gear 5. Therefore, the spraying arm 6 rotated in opposed directions sprays the water under pressure upon the tableware laid on the rack 9.

However, it has been noted that the above water spraying device has the following problems.

First, since the device has many elements, that is, the upper and lower frames 1*a* and 1*b*, two gears 4 and 5 and a connecting rod 7 hinged to both the arm 6 and the spur gear 5, its construction is very complex and inevitably deteriorates productivity of the tableware washer.

Second, the power transmission for rotating the spraying arm 6 is carried out by the gears 4 and 5, so that there is generated considerable noise in operation of the device.

Third, the arm rotating mechanism is only provided at one side of the spraying arm 6 even though this spraying arm 6 comprises two arm sections oppositely extending from the upper frame 1*a*, so that a stable and smooth rotation of the arm 6 cannot be achieved.

SUMMARY OF THE INVENTION

It is, therefore, an object of the present invention to provide a water spraying device for a tableware washer in which the aforementioned problems can be overcome and which has a support member, fixedly mounted on the top of a rotatable frame such that it is exposed to the outside of the frame, and connected to a spraying arm by a connecting rod, thus to cause the spraying arm to repeat an opposed directional rotation simultaneously with turning when the upper frame is turned, to enlarge the water spraying range and to improve the washing efficiency of the tableware washer.

In order to accomplish the above object, a water spraying device for a tableware washer in accordance with an embodiment of the present invention comprises a rotatable frame, a water spraying arm rotatably supported by the frame and turned along with the frame, a water guide member for guiding the water to the spraying arm, a fixed shaft mounted on the water guide member such that it vertically penetrates the support frame and exposes its top end to the outside of the support frame, a support member fixedly mounted on the top end of the shaft, a guider having a guide slot and fixedly mounted on the spraying arm, and a connecting rod movably placed on the support frame and levered by a hinge pin of the support frame, thus to convert a turning motion of the support frame into an opposed directional rotating motion of the spraying arm and to change the direction of the water spraying holes of the arm.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
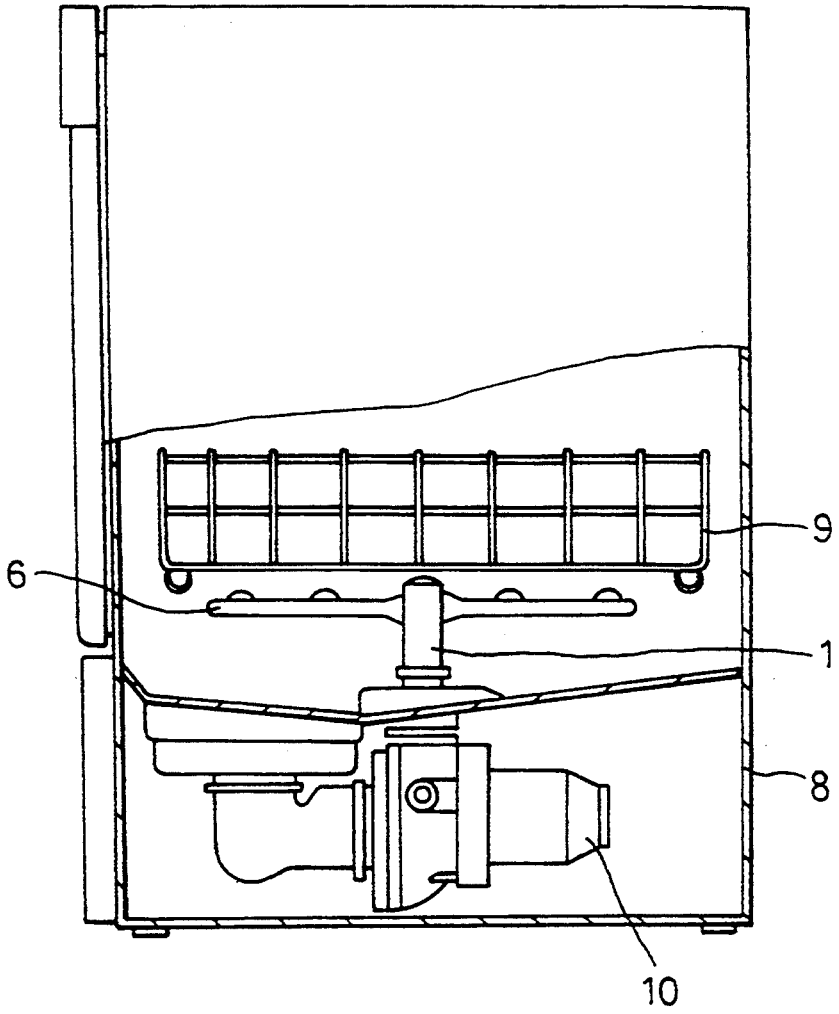
F I G. 1 PRIOR ART
FIG. 1 is a partially broken view of a conventional tableware washer.
Figure 2:
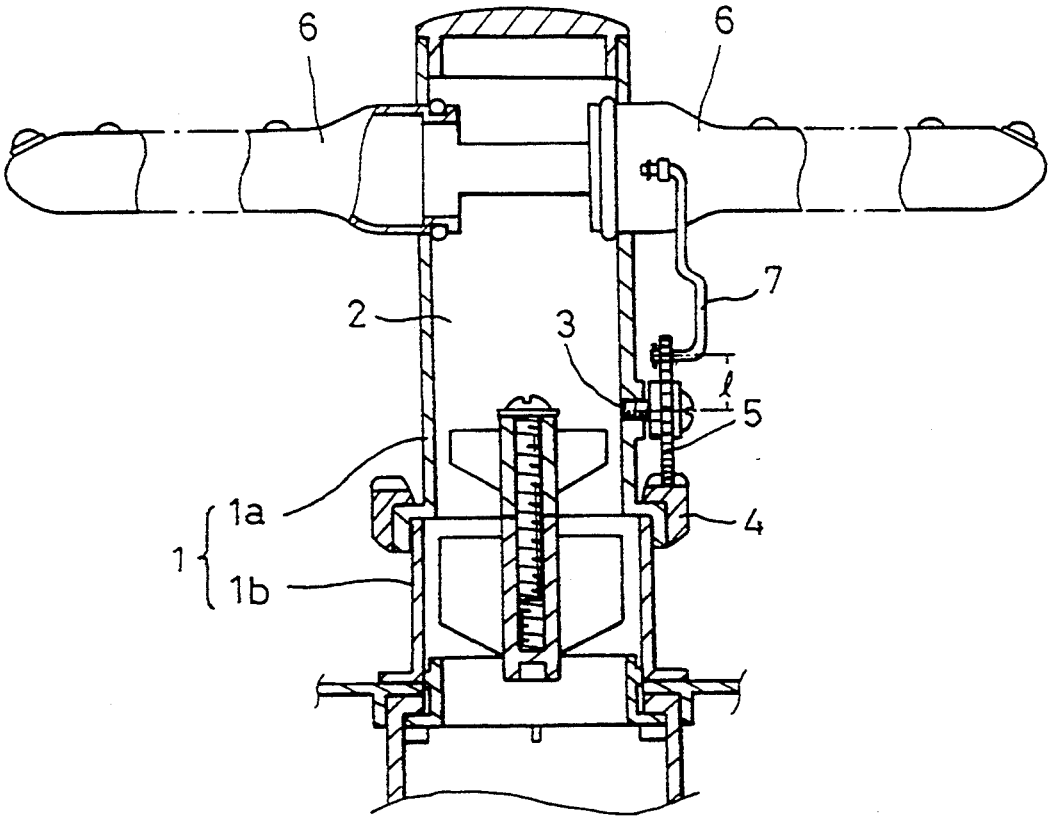
F I G. 2 PRIOR ART
FIG. 2 is a partially sectional view of a water spraying device of the washer of FIG. 1, especially showing a construction of a spraying arm rotating mechanism of the device.
Figure 3:
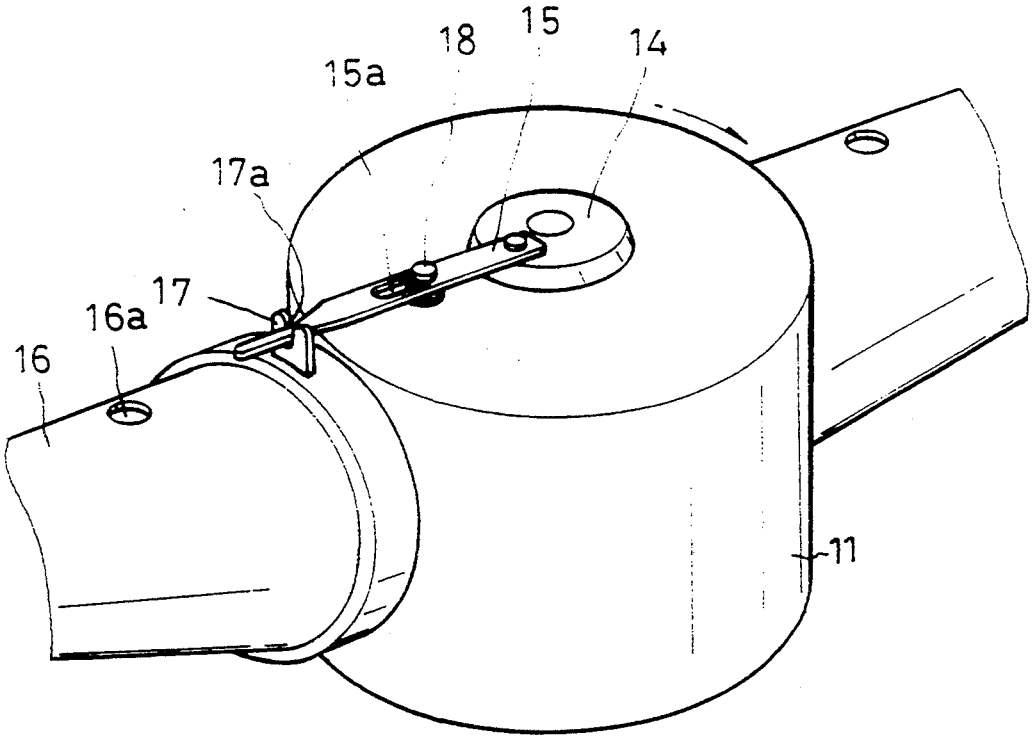
FIG. 3 is a perspective view of a water spraying device for a tableware washer in accordance with a primary embodiment of the present invention.
Figure 4:
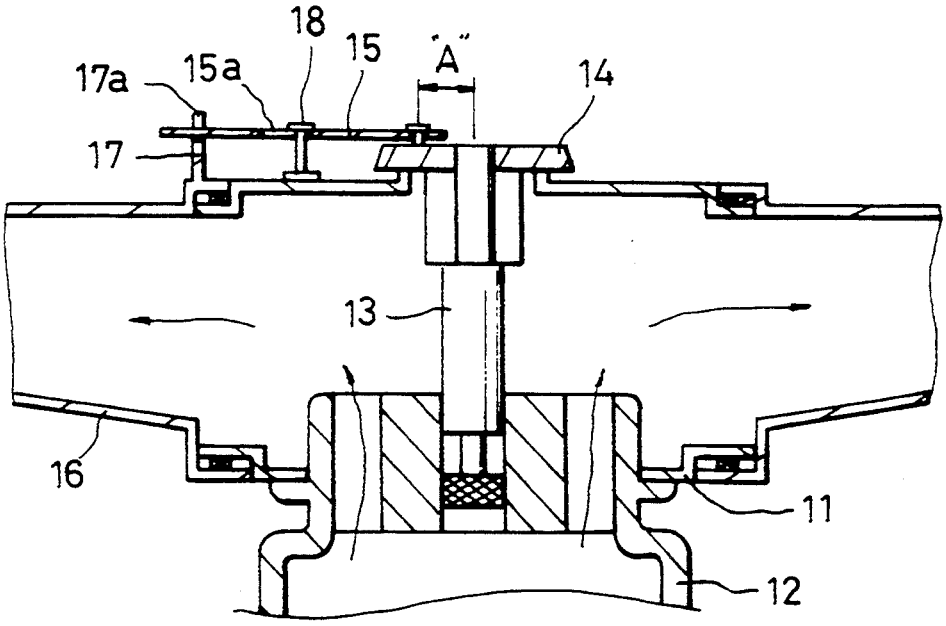
FIG. 4 is a sectional view of the device of FIG. 3.

Referring to FIGS. 3 and 4, there is shown a water spraying device for a tableware washer in accordance with a primary embodiment of the present invention. In the spraying device of this embodiment, a stationary shaft 13 is fixedly mounted on a water guide member 12 such that it vertically penetrates an arm support frame 11 in order to expose its top end to the outside of the frame 11. In addition, a support member 14 is fixedly mounted on the top end of the shaft 13.

In order to convert rotating motion of the frame 11 into a linear motion for alternately rotating a spraying arm 16 in opposed directions, the device includes spraying arm rotating means. In the primary embodiment of FIG. 3, this rotating means comprises a connecting rod 15 which is eccentrically hinged to the support member 14 at its rear end. The hinged portion of the support member 14 is eccentric from the center of the shaft 13. The spraying arm 16 is rotatably liquid-tightly coupled to the upper section of the frame 11 such that it diametrically extends outward from the frame 11. In the conventional manner, the spraying arm 16 is turned about the fixed support member 14 by a rotational force generated when the water under pressure is ejected from its eccentric holes. The spraying arm 16 is provided with a guider 17 having a guide slot 17*a*. This guide slot 17*a* movably receives a distal end of the connecting rod 15. The connecting rod 15 hinged to the support member 14 is provided at its middle section with a longitudinal hole 15*a* which movably receives a hinge pin 18 fixedly mounted on the frame 11. Thus, the connecting rod 15 is levered within a predetermined levering angle when the frame 11 as well as the spraying arm 16 is turned about the support member 14 by the rotational force caused by the pressurized water ejected from the eccentric holes of the arm 16.

At this time, the length of the longitudinal hole 15*a* of the connecting rod 15 should be not less than two times a distance A (see FIG. 4) between the hinged portion of the support member 14 and the center of the shaft 13.

To make the length of the hole 15*a* of the connecting rod 15 as described above is to allow the connecting rod 15 to smoothly shift its position while being levered and linearly moved under the guide of the hinge pin 18 when the frame 11 as well as the spraying arm 16 is turned about the fixed shaft 13.

In this regard, when the frame 11 having the spraying arm 16 is turned by the rotational force generated by the pressurized water ejected from the eccentric holes of the arm 16, the connecting rod 15 hinged to the support member 14 is levered and rotated about its hinged portion on the fixed support member 14. Hence, the distal end of the connecting rod 15, which is movably received in the guide slot 17*a* of the guider 17 and moved along with the turning arm 16, causes the spraying arm 16 to be rotated i n opposed directions perpendicular to its turning direction.

Figure 5A:
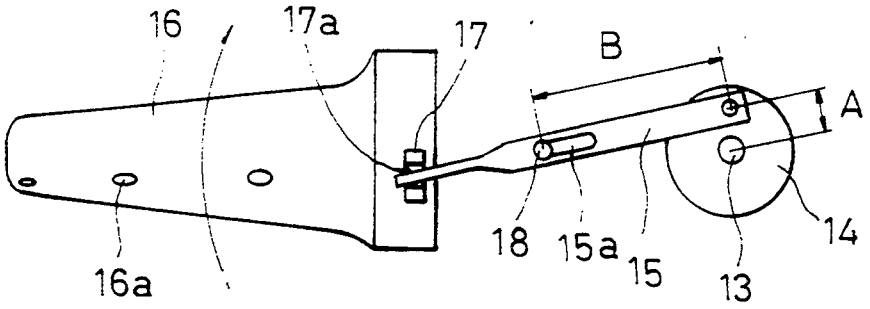
FIGS. 5*a* to 5*c* are schematic plan views of the device of FIG. 3, showing a spraying arm rotating operation of the device respectively.
Figure 5B:
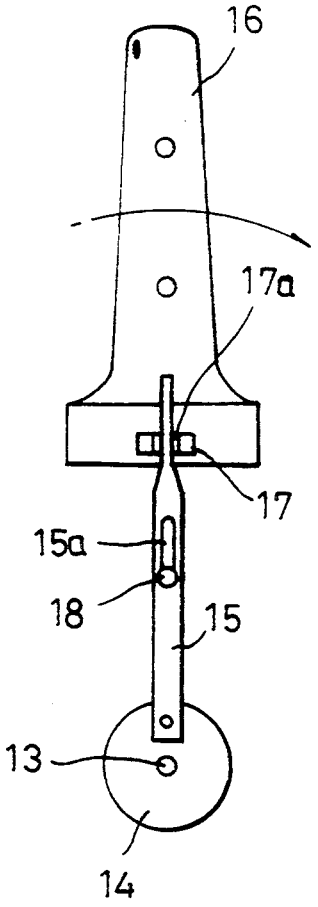
Figure 5C:
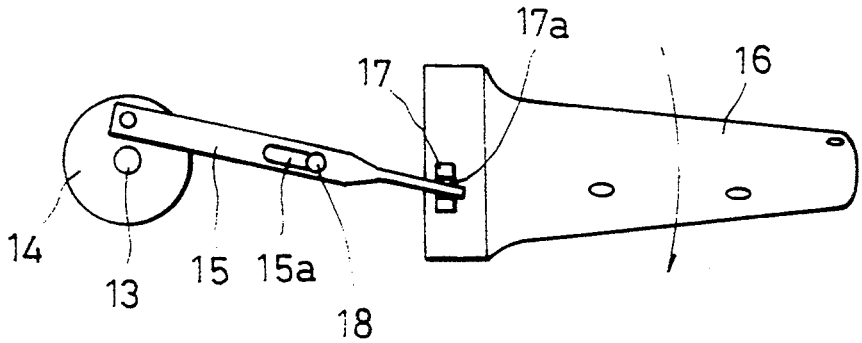

Turning to FIGS. 5*a* to 5*c*, there is shown a spraying arm rotating operation of the device of FIGS. 3 and 4. In operation of the tableware washer, a power switch of the washer is switched on under the condition that the tableware is laid on a rack inside the washer, a drive motor starts and generates a pumping force for supplying the water under a given pressure to the spraying arm 16 through a water passage in the water guide member 12. At this time, there is generated a rotating force in both the arm 16 and the frame 11 when the pressurized water is ejected from the eccentric holes of the arm 16. Hence, the arm 16 and the frame 11 are turned about the fixed support member 14.

When the spraying arm 16 and the frame I 1 in the state of FIG. 5*a* are turned clockwise about the fixed support member 14, the hinge pin 18 mounted on the frame 11 is turned clockwise about the shaft 13. The connecting rod 14 eccentrically hinged to the support member 14 is thus turned and levered.

Since the distal end of the connecting rod 15 i s movably received in the guide slot 17*a* of the guider 17, the levering motion of the connecting rod 15 causes the spraying arm 16 to be rotated in opposed directions perpendicular to the turning direction of the frame 11.

That is, when the frame 11 in the state of FIG. 5*a* is turned clockwise at an angle of 90°, the connecting rod 15 is pushed by the hinge pin 18 of the frame 11 and turned clockwise about its hinged portion on the support member 14. At this time, since the distal end is movably received in the guide slot 17*a* of the guider 17, the spraying arm 16 is rotated clockwise at the same time of clockwise turning in order to direct upward its water spraying holes 16*a* as shown in FIG. 5*b*.

When the frame 11 in the state of FIG. 5*b* is turned more clockwise, the clockwise turning motion of the connecting rod 15 about the hinged portion is continued, thus to make the spraying arm 16 be rotated clockwise. Therefore, the tilted state of the arm 16 shown in FIG. 5*c* is achieved.

If briefly described, the above rotation of the spraying arm 16 for changing the direction of the water spraying holes 16*a* is achieved by the fact that the connecting rod 15 eccentrically hinged to the fixed support member 14 is movably received in the guide slot 17*a* of the guider 17 at its distal end and movably receives the hinge pin 18 of the frame 11 in the longitudinal hole 15*a* of its middle section.

When the frame 11 in the state of FIG. 5*c* is turned more clockwise, the spraying arm 16 is rotated counterclockwise at the same time of clockwise turning about the shaft 13 in order to direct upward its water spraying holes 16*a* and, thereafter, return to the tilted state of FIG. 5*a*.

Therefore, the device according to the above embodiment of this invention makes the spraying arm 16 repeat its opposed directional rotation in accordance with turning motion of the frame 11, thus to change the direction of the water spraying holes 16*a* of the arm 16 in a predetermined angle and to change the water spraying direction of the arm 16.

Figure 6:
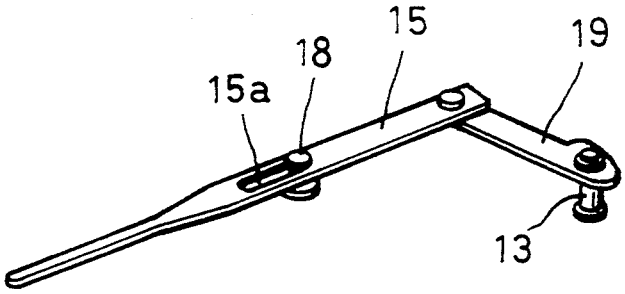
FIG. 6 is a perspective view of spraying arm rotating means in accordance with another embodiment of the present invention.

FIG. 6 is a perspective view of another embodiment of the spraying arm rotating means of the device. Differently from the primary embodiment, the arm rotating means of this embodiment has no fixed support member 14 but includes a link 19 fixedly mounted on the fixed shaft 13. The connecting rod 15, of which the distal end is movably received in the guide slot 17*a* of the guider 17 of the spraying arm 16 and the longitudinal hole 15*a* movably receives the hinge pin 18 of the frame 11, is hinged to the link 19 at its rear end. The connecting rod 15 is levered within a predetermined levering angle when the frame 11 as well as the spraying arm 16 is rotated about the fixed shaft 13, thus to yield the same result as that described for the primary embodiment without affecting the functioning of this invention and further explanation is thus not deemed necessary.

As described above, the water spraying device according to the primary embodiment changes the distance B between the eccentric hinged portion of the connecting rod 15 and the hinge pin 18 of the frame 11. Hence, the device rotates the spraying arm 16 and changes the direction of the water spraying holes 16*a* of the arm 16 when the frame 11 is turned about the fixed shaft 13.

Figure 7:
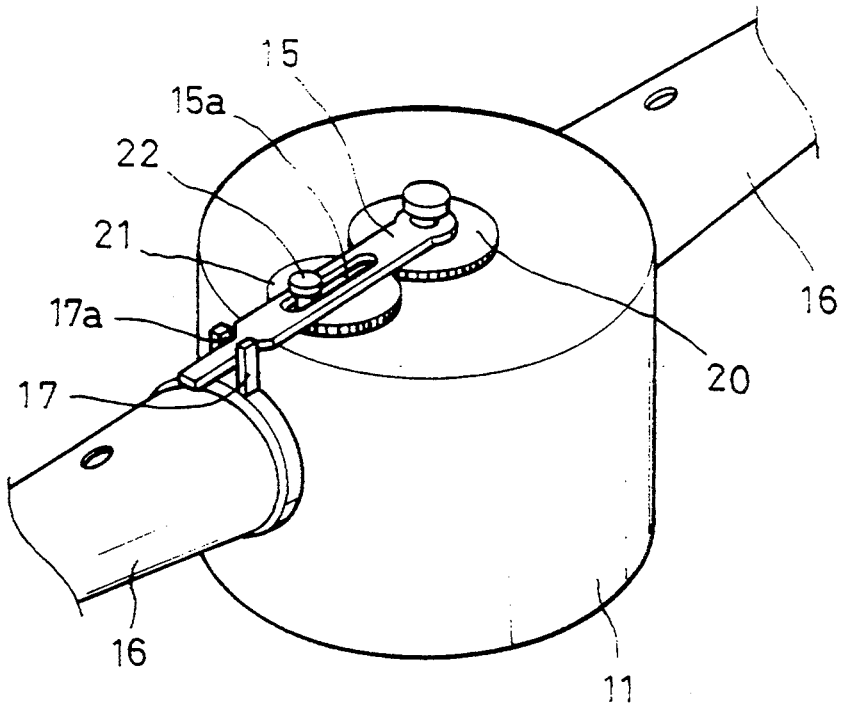
FIG. 7 is a perspective view of a water spraying device for a tableware washer in accordance with a second embodiment of the present invention.
Figure 8:
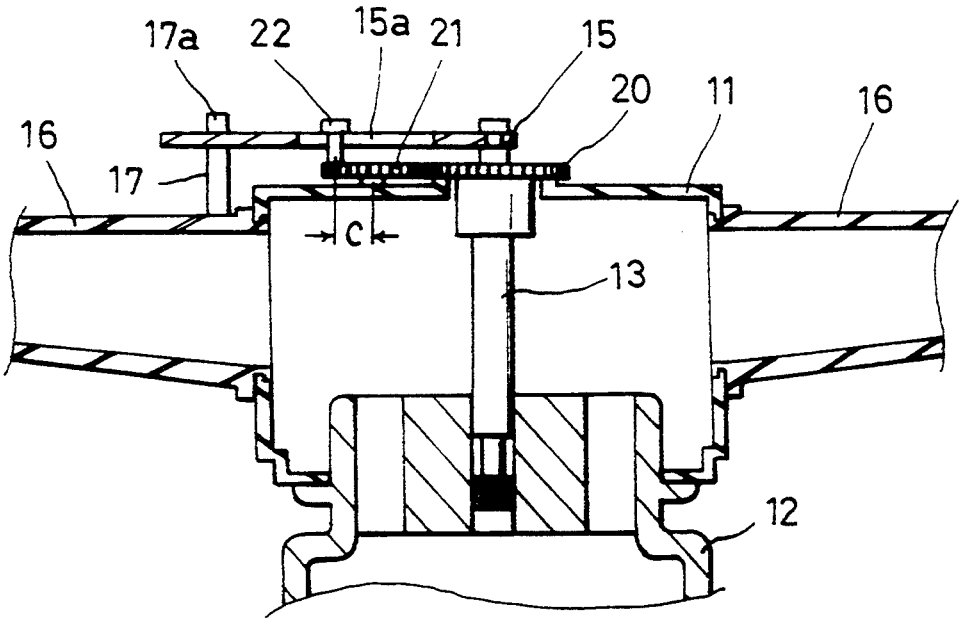
FIG. 8 is a sectional view of the device of FIG. 7.

Referring next to FIGS. 7 and 8, there is shown a water spraying device for a tableware washer in accordance with a second embodiment of the present invention. In the same manner as described for the primary embodiment, the spraying device of this second embodiment includes the fixed shaft 13 which is mounted on the water guide member 12. The fixed shaft 13 vertically penetrates the arm support frame 11 in order to expose its top end to the outside of the frame 11. The spraying arm rotating means of this second embodiment comprises a first spur gear 20 which is fixedly mounted on the exposed top end of the shaft 13.

The frame 11 is provided with a second spur gear 21 which is rotatably mounted on the top surface of the frame 11 and gears into the first spur gear 21. The spraying arm 16, which is turned along with the frame 11 about the fixed shaft 13 when the pressurized water is ejected from the eccentric holes of the arm 16, is provided with the guider 17 having the guide slot 17*a* as described for the primary embodiment.

In this second embodiment, the connecting rod 15 is hinged to the fixed shaft 13 at its rear end and movably received in the guide slot 17*a* of the guider 17 at its distal end.

The connecting rod 15 is provided at its middle section with the longitudinal hole 15*a* which movably receives a guide pin 22 which is eccentrically mounted on the second spur gear 21 gearing into the first gear 20. Hence, when both the frame 11 and the spraying arm 16 are turned about the fixed shaft 13 by the rotational force caused by the pressurized water ejected from the eccentric holes of the arm 16, the connecting rod 15 is levered within a predetermined levering angle corresponding to two times of a distance C (see FIG. 8) between the guide pin 22 and the center of the second spur gear 21, thus to rotate the spraying arm 16 in order to change the direction of the water spraying holes 16*a* of the arm 16.

Figure 9A:
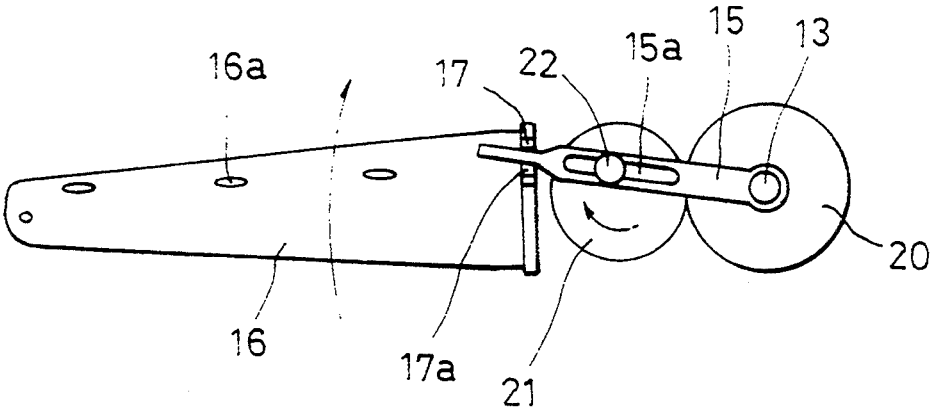
FIGS. 9*a* to 9*c* are schematic plan views of the device of FIG. 7, showing a spraying arm rotating operation of the device respectively.
Figure 9B:
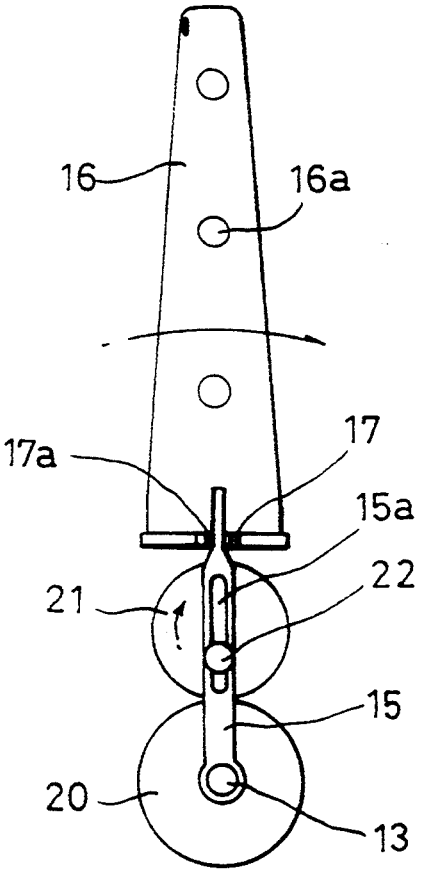
Figure 9C:
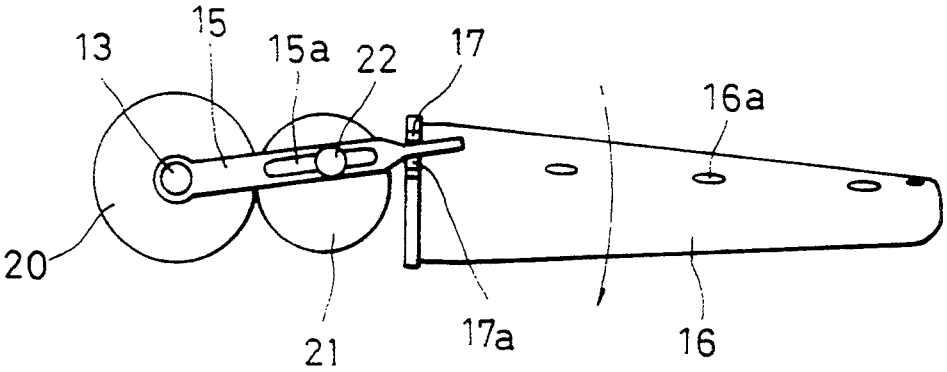

FIGS. 9*a* to 9*c* show a spraying arm rotating operation of the device of the second embodiment. In operation of the tableware washer, the power switch of the washer is switched on under the condition that the tableware is laid on the rack inside the washer, the drive motor starts and generates the pumping force for supplying the pressurized water to the spraying arm 16 through the water passage in the water guide member 12. At this time, there is generated a rotating force in both the arm 16 and the frame 11 when the pressurized water is ejected from the eccentric holes of the arm 16. Hence, the arm 16 and the frame 11 are turned clockwise about the fixed shaft 13.

When both the spraying arm 16 and the frame 11 are turned clockwise about the fixed shaft 13, the second spur 9ear 21 rotatably mounted on the frame 11 is changed in its position. That i s, the second gear 21 gearing into the fixed first gear 20 is rotated on its shaft and, at the same time, turned about the fixed shaft 13 as a result of the turning motion of the frame 11.

Therefore, the eccentric guide pin 22 of the second spur gear 21 moves in the longitudinal hole 15*a* of the connecting rod 15, thus to lever the connecting rod 15 about the fixed shaft 13.

If described in detail, when the spraying arm 16 and the frame 11 in the state of FIG. 9*a* are turned clockwise about the fixed shaft 13 due to ejection of the pressurized water, the rotatable second spur gear 21 gearing into the fixed first gear 20 is rotated clockwise on its shaft and turned clockwise about the shaft 13 at an angle of 90° as shown in FIG. 9*b*. The guide pin 22 of the second gear 21 thus moves along the longitudinal hole 15*a* of the connecting rod 15 and levers connecting rod 15 about the fixed shaft 13. The distal end of the connecting rod 15 movably received in the guide slot 17*a* of the guider 17 thus pushes the guider 17 and rotates the spraying arm 16.

Accordingly, the water spraying holes 16*a* of the spraying arm 16 is directed upward as shown in FIG. 9*b*.

When the frame 11 in the state of FIG. 9*b* is more turned clockwise, the connecting rod 15 is levered counterclockwise about the fixed shaft 13, thus to make the spraying arm 16 be rotated in order to achieve the tilted state shown in FIG. 9*c*.

The continued turning motion of the frame 11 causes the spraying arm 16 to be rotated in a reversed direction and to return to the tilted state of FIG. 9*a*.

Therefore, the device according to the second embodiment of this invention makes the spraying arm 16 repeat its opposed directional rotation in accordance with turning motion of the frame 11, thus to change the direction of the water spraying holes 16*a* of the arm 16 in a predetermined angle and to change the water spraying direction with respect to the rack on which the tableware is laid.

Figure 10:
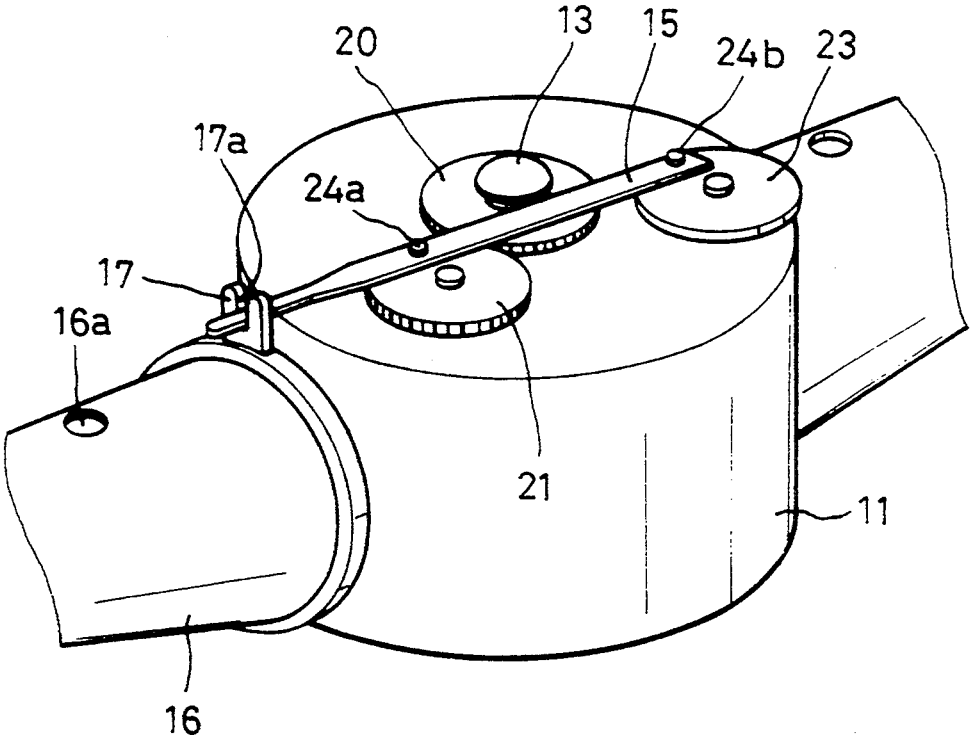
FIG. 10 is a perspective view of a water spraying device for a tableware washer in accordance with a third embodiment of the present invention.
Figure 11:
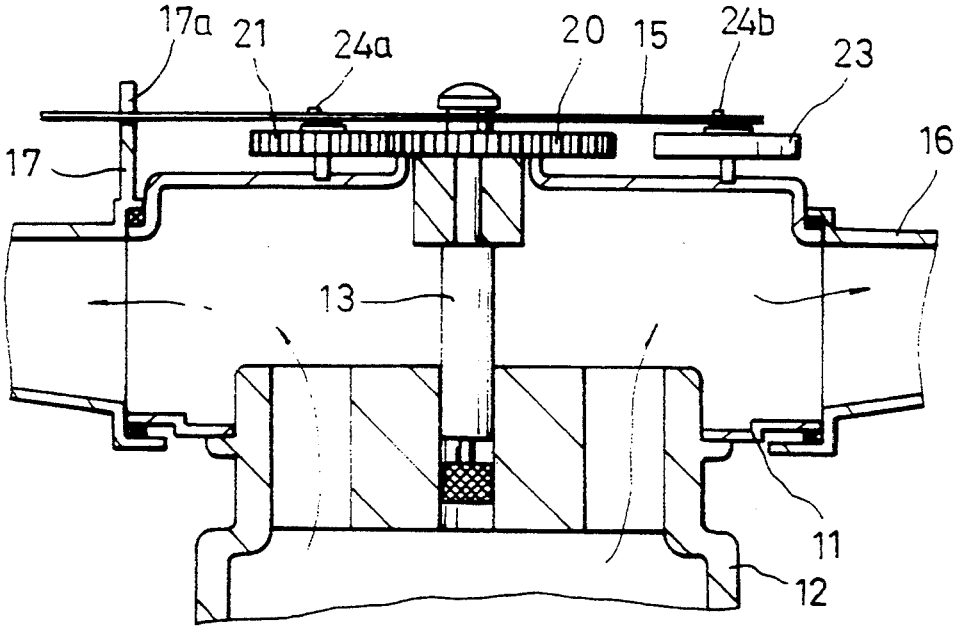
FIG. 11 is a sectional view of the device of FIG. 10.

FIGS. 10 and 11 show a water spraying device for a tableware washer in accordance with a third embodiment of the present invention. In the same manner as described for the primary and second embodiments, the spraying device of this third embodiment includes the fixed shaft 13 which is mounted on the water guide member 12. The fixed shaft 13 vertically penetrates the arm support frame 11 in order to expose its top end to the outside of the frame 11. The spraying arm rotating means of this third embodiment comprises the first spur gear 20 which is fixedly mounted on the exposed top end of the shaft 13.

The frame 11 is provided with the second spur gear 21 which is rotatably mounted on the top surface of the frame 11 and gears into the first spur gear 21. In addition, a rotatable disc 23 is mounted on the frame 11 such that it is opposed to the second spur gear 21.

The spraying arm 16 of the frame 11 is provided with the guider 17 having the guide slot 17*a*. The connecting rod 15, of which the distal end is movably received in the guide slot 17*a* of the guider 17, is hinged to an eccentric portion of the rotatable disc 23 at its rear end and hinged to an eccentric portion of the second spur gear 21 at its middle section, thus to convert the rotating motion of the second gear 21 into a linear reciprocating motion. In order to hinge the connecting rod 15 to both the second gear 21 and the rotatable disc 23, the second gear 21 and the rotatable disc 23 are provided with their respective hinge pins 24*a* and 24*b*.

In this second embodiment, the rotating velocity of the spraying arm 16 is controlled by changing the diameters of the first and second spur gears 20 and 21 and the gear ratio of the first gear 20 to the second gear 21.

Here, the diameter of the second spur gear 21 should be equal to that of the rotatable disc 23.

Figure 12A:
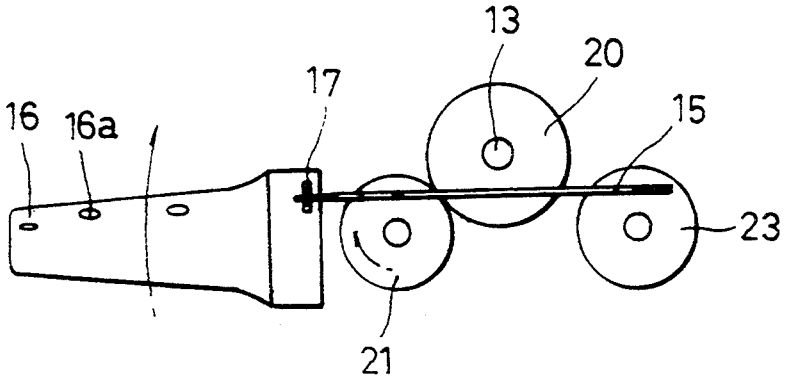
FIGS. 12*a* to 12*c* are schematic plan views of the device of FIG. 10, showing a spraying arm rotating operation of the device respectively.
Figure 12B:
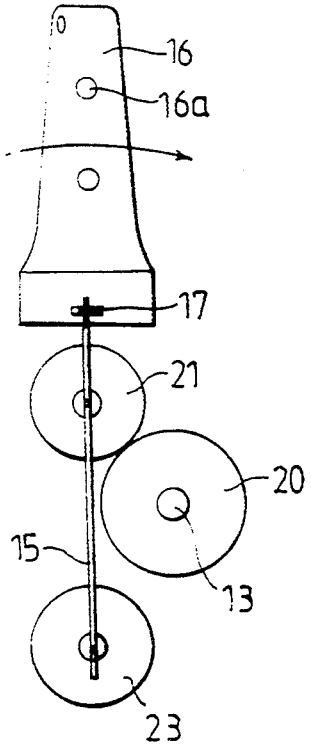
Figure 12C:
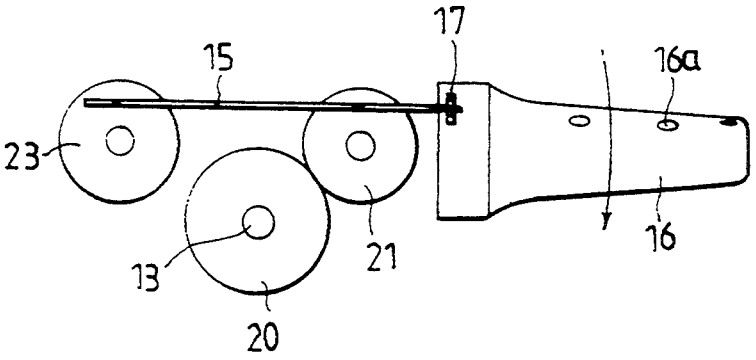

FIGS. 12*a* to 12*c* show a spraying arm rotating operation of the device of the third embodiment. In operation of the tableware washer, the power switch of the washer is switched on under the condition that the tableware is laid on the rack inside the washer, the drive motor starts and generates the pumping force for supplying the pressurized water to the spraying arm 16 through the water passage in the water guide member 12. At this time, there is generated a rotating force in both the arm 16 and the frame 11 when the pressurized water is ejected from the eccentric holes of the arm 16. Hence, the arm 16 and the frame 11 are turned clockwise about the fixed shaft 13.

When both the spraying arm 16 and the frame 11 are turned clockwise about the fixed shaft 13, the second spur gear 21 rotatably mounted on the frame 11 is changed in its position. That is, the second gear 21 gearing into the fixed first gear 20 is rotated clockwise on its shaft and, at the same time, turned clockwise about the fixed shaft 13 as a result of the turning motion of the frame 11.

Therefore, the connecting rod 15 hinged to the pin 24*a* of the second spur gear 21 pushes the guider 17 of the arm 16, thus to direct upward the water spraying holes 16*a* of the arm 16 as shown in FIG. 12*b*.

At this time, the rotatable disc 23, which is mounted on the frame 11 and hinged to the rear end of the connecting rod 15 by the pin 24*b*, is turned about the shaft 13 along with the frame 11 and rotated on its shift, so that it al lows the connecting rod 15 to horizontally move.

When the frame 11 in the state of FIG. 12*b* is turned more clockwise, the connecting rod 15 is levered about the fixed shaft 13, thus to make the spraying arm 16 be rotated in order to achieve the tilted state shown in FIG. 12*c*.

The continued turning motion of the frame 11 changes the position of the pin 24*a* of the second spur gear 21 and causes the spraying arm 16 to be rotated in a reversed direction and to return to the tilted state of FIG. 12*a*.

Therefore, the device according to the third embodiment of this invention makes the spraying arm 16 repeat its opposed directional rotation in accordance with turning motion of the frame 11, thus to change the direction of the water spraying holes 16*a* of the arm 16 in a predetermined angle and to change the water spraying direction with respect to the rack on which the tableware is laid.

Figure 13:
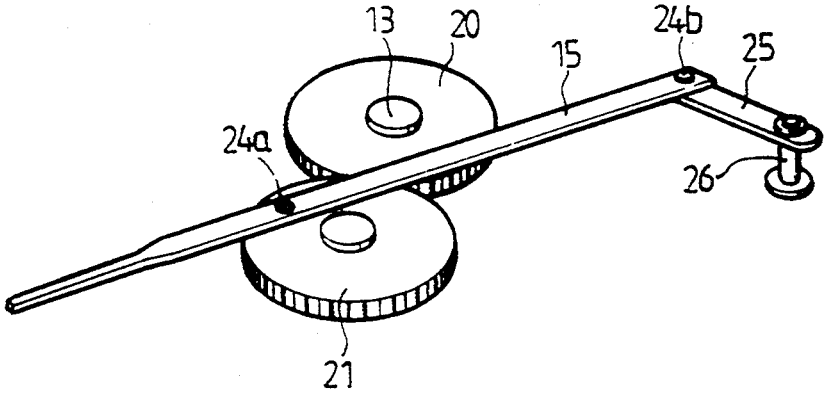
FIG. 13 is a perspective view of spraying arm rotating means in accordance with still another embodiment of the present invention.

FIG. 13 is a perspective view of spraying arm rotating means according to still another embodiment of the present invention. Differently from the above third embodiment, the rear end of the connecting rod 15 of this embodiment, is hinged to a link 25 which is fixedly mounted on a fixed shaft 26. The fixed shaft 26 is mounted on the frame 11 such that it is opposed to the second spur gear 21, The connecting rod 15 is levered within a predetermined levering angle when the frame 11 as well as the spraying arm 16 is rotated about the fixed shaft 13, thus to yield the same result as that described for the third embodiment without affecting the functioning of this invention and further explanation is thus not deemed necessary.

A water spraying device for a tableware washer according to the present invention shows the following advantages.

First, it has a simple construction, thus to improve the productivity of the tableware washer.

Second, the connecting rod mounted on the frame rotates the spraying arm in order to change the direction of the water spraying holes of the arm when the frame as well as the spraying arm is turned about the fixed shaft, thus to generate no operational noise during its operation.

Third, the spraying arm rotating means of the device is placed on the frame, so that the device achieves a stable operation.

Although the preferred embodiments of the present invention have been disclosed for illustrative purposes, those skilled in the art will appreciate that various modifications, additions and substitutions are possible, without departing from the scope arid spirit of the invention as disclosed in the accompanying claims.

What is claimed is:

1. A water spraying device for a tableware washer comprising:

a rotatable support frame;

a water spraying arm rotatably supported by and laterally extending from said support frame, said spraying arm being turned along with said support frame when water is sprayed therefrom;

a water guide member for guiding the water to said spraying arm;

a fixed shaft mounted in said water guide member such that it vertically penetrates said support frame and exposes its top end to the outside of said support frame;

support means fixedly mounted on said top end of said shaft;

a guider fixedly mounted on said spraying arm said guider having a guide slot; and a connecting rod placed on said support frame with one end of said connecting rod hinged to said support means mounted on said support frame and the other end of said connecting rod movably received in said guide slot of said guider for levering by a hinge pin of said support frame, thus, a turning motion of said support frame is converted into an opposed directional rotating motion of said spraying arm.

2. The water spraying device according to claim 1, wherein said connecting rod has a longitudinal hole for movably receiving said hinge pin of the support frame.

3. The water spraying device according to claim 1, wherein said support means is a fixed disc concentrically mounted on said fixed shaft.

4. The water spraying device according to claim 1, wherein said support means is a link fixed to said fixed shaft at one end thereof and hinged to said one end of the connecting rod at the other end thereof.

5. A water spraying device for a tableware washer comprising:

a rotatable support frame;

a water spraying arm rotatably supported by and laterally extending from said support frame, said spraying arm being turned along with said support frame when water is sprayed therefrom;

a water guide member for guiding the water to said spraying arm;

a fixed shaft mounted in said water guide member such that it vertically penetrates said support frame and exposes its top end to the outside of said support frame;

a first gear fixedly mounted on said top end of said shaft;

a second gear rotatably mounted on said support frame such that it gears into said first gear, said second gear having an eccentric hinge pin thereon;

a guider fixedly mounted on said spraying arm, said guider having a guide slot; and a connecting rod hinged to said fixed shaft at one end thereof and movably received in said guide slot of the guider at the other end thereof such that it is levered by said eccentric hinge pin of the second gear during a turning motion of said support frame, thus converting said burning motion of the support frame into an opposed directional rotating motion of said spraying arm.

6. The water spraying device according to claim 2, wherein said connecting rod has a longitudinal hole for movably receiving said eccentric hinge pin of the second gear.

7. A water spraying device for a tableware washer comprising:

a rotatable support frame;

a water spraying arm rotatably supported by and laterally extending from said support frame, said spraying arm being turned along with said support frame when water is sprayed therefrom;

a water guide member for guiding the water to said spraying arm;

a fixed shaft mounted in said water guide member such that it vertically penetrates said support frame and exposes its top end to the outside of said support frame;

a first gear fixedly mounted on said top end of said shaft;

a second gear rotatably mounted on said support frame such that it gears into said first gear, said second gear having an eccentric hinge pin thereon;

rotating means rotatably mounted on said support frame such that it is opposed to said second gear about said first gear;

a guider fixedly mounted on said spraying arm, said guider having a guide slot; and a connecting rod placed on said support frame such that one end of said connecting rod is eccentrically hinged to said rotating means mounted on said support frame and the other end of said connecting rod is movably received in said guide slot of said guider for levering by a hinge pin of said support frame, thus, a turning motion of said support frame is converted into an opposed directional rotating motion of said spraying arm.

8. The water spraying device according to claim 7, wherein said rotating means is a disc rotatably mounted on said support frame.

9. The water spraying device according to claim 7, wherein said rotating means is a link rotatably mounted on said support frame at one end thereof and hinged to said one end of the connecting rod at the other end thereof.

* * * * *